US005230116A

United States Patent [19]

Rodriguez

[11] Patent Number: 5,230,116

[45] Date of Patent: Jul. 27, 1993

[54] ANTI-SCRATCH TOILET SNAKE

[76] Inventor: Jose Rodriguez, 120 Central Park South, New York, N.Y. 10019

[21] Appl. No.: 930,269

[22] Filed: Aug. 14, 1992

[51] Int. Cl.[5] ..... B08B 9/02

[52] U.S. Cl. ..... 15/104.33

[58] Field of Search ..... 15/104.33, 104.16; 254/134.7

[56] References Cited

U.S. PATENT DOCUMENTS 3,121,244 2/1964 Hunt ..... 15/104.33
3,364,140 12/1982 Irwin ..... 15/104.33

FOREIGN PATENT DOCUMENTS 1784116 3/1972 Fed. Rep. of Germany ... 15/104.33
0365261 1/1932 United Kingdom ..... 15/104.33

*Primary Examiner*—Edward L. Roberts
*Attorney, Agent, or Firm*—Richard L. Miller

[57] ABSTRACT

An anti-scratch toilet snake is provided which consists of a closet auger for opening a clogged drain in a toilet bowl and a scratch preventing improvement mechanism on a portion of the closet auger that is inserted into the clogged drain of the toilet bowl, for preventing scratches to a porcelain surface in the toilet bowl.

3 Claims, 1 Drawing Sheet

ANTI-SCRATCH TOILET SNAKE

BACKGROUND OF THE INVENTION

The instant invention relates generally to drain cleaning apparatuses and more specifically it relates to an anti-scratch toilet snake.

Numerous drain cleaning apparatuses have been provided in the prior art that are adapted to route out foreign material from plumbing pipes and the like by the use of rotating elongated cleaning snakes. For example, U.S. patents numbered U.S. Pat. Nos. 4,257,139 to Yeo; 4,570,281 to Boelens and 4,916,772 to Russell et al. all are illustrative of such prior art. While these units may be suitable for the particular purpose to which they address, they would not be as suitable for the purpose of the present invention as hereafter described.

SUMMARY OF THE INVENTION

A primary object of the present invention is to provide an anti-scratch toilet snake that will overcome the shortcomings of the prior art devices.

Another object is to provide an anti-scratch toilet snake that contains a protective covering located on a lower right angle end of an elongated sleeve of a closet auger to prevent a porcelain surface at a drain in a toilet bowl from receiving scratches.

An additional object is to provide an anti-scratch toilet snake that further contains a protective end cap located where a snake member exits from the lower right angle end of the elongated sleeve so as to add extra cushioning thereto in preventing scratches to the porcelain surface at the drain in the toilet bowl.

A further object is to provide an anti-scratch toilet snake that is simple and easy to use.

A still further object is to provide an anti-scratch toilet snake that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be mode in the specific construction illustrated and described within the scope of the appended claims.

BRIEF DESCRIPTION OF THE DRAWING FIGURES

The figures in the drawing are briefly described as follows.

DETAILED DESCRIPTION OF THE PREFERRED EMBODIMENTS

Figure 1:
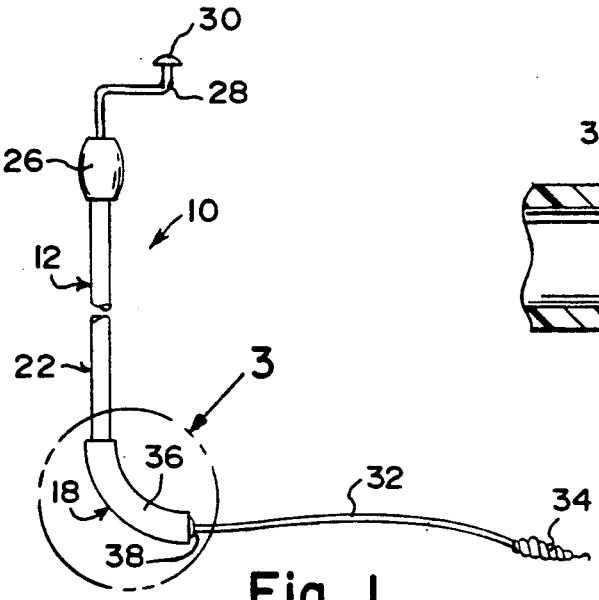
FIG. 1 is a diagrammatic side elevational view of the instant invention.
Figure 4:
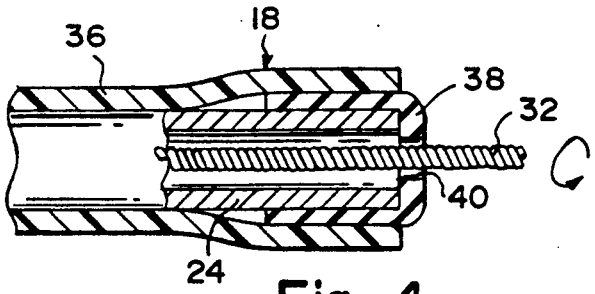
FIG. 4 is a still further enlarged diagrammatic cross sectional view illustrating the area indicated by arrow 4 in FIG. 3.
Figure 2:
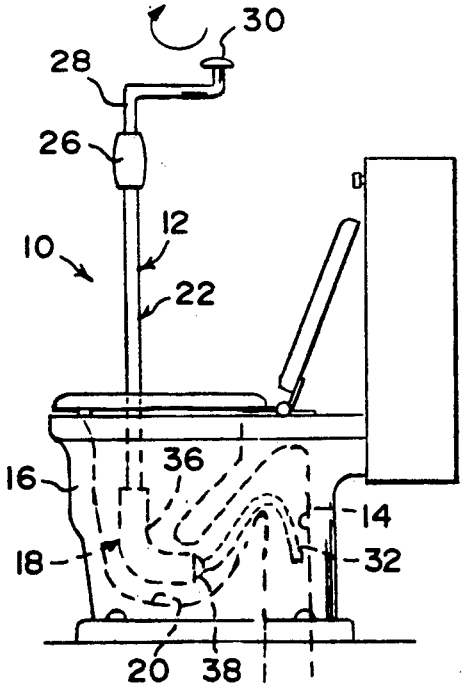
FIG.2 is a diagrammatic side elevational view illustrating the instant invention being used to clean a toilet bowl drain without scratching the visible portion of the porcelain therein.
Figure 3:
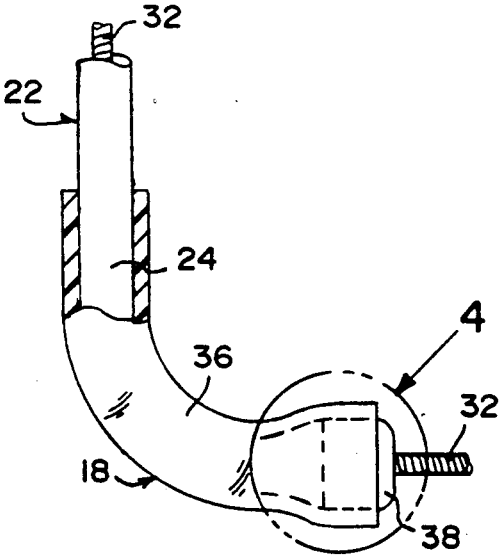
FIG. 3 is an enlarged diagrammatic side view illustrating the area indicated by arrow 3 in FIG. 1.

Turning now descriptively to the drawings, in which similar reference characters denote similar elements throughout the several views, the Figures illustrate an anti-scratch toilet snake 10 which consists of a closet auger 12 for opening a clogged drain 14 in a toilet bowl 16. A scratch preventing improvement mechanism 18 on a portion of the closet auger 12 that is inserted into the clogged drain 14 in the toilet bowl 16, is for preventing scratches to a porcelain surface 20 in the toilet bowl 16.

The closet auger 12 contains an elongated sleeve 22 having a lower right angle end 24, with a handle 26 attached to an upper end of the elongated sleeve 22. A crank arm 28 is rotatively attached to the handle 26 and a head 30 is secured to the crank arm 28. An elongated snake member 32 is affixed at one end to the crank arm 28, while extending through the handle 26, the elongated sleeve 22 and out of the lower right angle end 24. A spiral tip 34 is located on a distal end of the elongated snake member 32 to engage with the clogged drain 14 in the toilet bowl 16. When a person grips the handle 26 in one hand and the head 30 in another hand to turn the crank arm 28, the elongated snake member 32 and the spiral tip 34 will rotate to open the clogged drain 14 in the toilet bowl 16.

The scratch preventing improvement mechanism 18 includes a protective flexible covering 36 which fits over the lower right angle end 24 of the elongated sleeve 22. A protective flexible end cap 38 having a central aperture 40 therethrough is also provided. The protective flexible end cap 38 fits over a distal end of the lower right angle end 24 of the elongated sleeve 22 and under the protective flexible covering 36, to allow the elongated snake member 32 to extend through the central aperture 40, so that the protective flexible end cap 38 can add extra cushioning thereto in preventing scratches to the porcelain surface 20 at the drain 14 in the toilet bowl 16, while simultaneously not being able to be inadvertently dislodged from the lower right angle end 24 when same is removed from the toilet bowl 16.

The protective flexible covering 36 and the protective flexible end cap 38 are fabricated out of a soft plastic material, as shown in the drawing. Other materials (not shown) can be utilized, such as rubber, teflon coated plastic, waterproof felt and the like.

In operation use the anti-scratch toilet snake 10, is used as follows:

1. Insert the lower right angle end 24 with the elongated snake member 32 into the toilet bowl 16 until the clog is engaged.
2. Grip the handle 26 with one hand.
3. Grip the head 30 with another hand.
4. Turn the crank arm 28 so that the elongated snake member 32 with the spiral tip 34 rotates to free the clogged drain 14.
5. The protective flexible covering 36 and the protective flexible end cap 38 will prevent the lower right angle end 24 of the elongated sleeve 22 from scratching the porcelain surface 20 within the toilet bowl 16.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An anti-scratch toilet snake which comprises a closet auger for opening a clogged drain of a toilet bowl and means on a portion of said closet auger that is inserted into the clogged drain of the toilet bowl, for preventing scratches to a porcelain surface in the toilet bowl, said closet auger including:

a) an elongated sleeve having a lower right angle end;

b) a handle attached to an upper end of said elongated sleeve;

c) a crank arm rotatively attached to said handle;

d) a head secured to said crank arm:

e) an elongated snake member affixed at one end to said crank arm, while extending through said handle, said elongated sleeve and out of said lower right angle end; and f) a spiral tip located on a distal end of said elongated snake member to engage with a clogged in the drain of the toilet bowl, so that when a person grips said handle in one hand and said head in another hand and turn said crank arm, said elongated snake member and said spiral tip rotates to open the clogged drain in the toilet bowl, wherein said scratch preventing means including a protective flexible sleeve form covering which fits over said lower right angle end of said elongated sleeve and a protective flexible end cap having a central aperture therethrough, and said protective flexible end cap fitting over a distal end of said lower right angle end of said elongated sleeve under said protective flexible covering, to allow said elongated snake member to extend through said central aperture, and so that the distal end is radially enlarged and said protective flexible end cap can add extra cushioning thereto in preventing scratches to the porcelain surface at the drain in the toilet bowl.

2. An anti-scratch toilet snake according to claim 1 wherein the central aperture of the end cap has a diameter smaller than an internal diameter of said elongated sleeve.

3. An anti-scratch toilet snake according to claim 2 wherein the protective flexible sleeve-form covering tapers in smoothly as it extends away from the radially enlarged distal end.

* * * * *